US005131440A

United States Patent [19]

Quinn

[11] Patent Number: 5,131,440

[45] Date of Patent: Jul. 21, 1992

[54] LIQUID DISPENSING SYSTEM AND PACKAGING APPARATUS WHICH INCLUDES SUCH A SYSTEM

[75] Inventor: Thomas P. Quinn, Swords, Ireland

[73] Assignee: Arthur Guinness Son & Company (Dublin) Limited, Dublin, Ireland

[21] Appl. No.: 575,980

[22] Filed: Aug. 31, 1990

[30] Foreign Application Priority Data

Sep. 4, 1989 [GB] United Kingdom ..... 8919973

[51] Int. Cl.[5] ..... B65B 31/04

[52] U.S. Cl. ..... 141/63; 141/67; 141/90

[58] Field of Search ..... 141/46, 54, 63, 70, 141/82, 89, 90, 91, 92, 287, 4, 9, 47, 48, 66, 67, 103; 222/3, 61, 148, 149

[56] References Cited

U.S. PATENT DOCUMENTS

| | | | |
|---|---|---|---|
| 3,354,917 | 11/1967 | Swanson | 141/54 |
| 3,385,327 | 5/1968 | Granier | 141/46 X |
| 3,584,661 | 6/1971 | Riesenberg | 141/63 X |
| 3,774,655 | 11/1973 | Trusselle | 141/90 X |
| 3,926,229 | 12/1975 | Scholle | 141/90 X |
| 4,009,739 | 3/1977 | Weatherford | 141/90 X |
| 4,273,263 | 6/1981 | Voegele et al. | 222/148 |
| 4,790,359 | 12/1988 | Whitford | 141/67 |
| 4,862,696 | 9/1989 | Runkvist et al. | 141/67 X |
| 4,865,088 | 9/1989 | Stearns | 141/67 X |

FOREIGN PATENT DOCUMENTS

| | | | |
|---|---|---|---|
| 1024217 | 3/1966 | United Kingdom | 141/63 |
| 1438364 | 6/1976 | United Kingdom | 141/70 |
| 2081235 | 2/1982 | United Kingdom | 141/90 |

*Primary Examiner*—William A. Cuchlinski, Jr.
*Assistant Examiner*—G. Bradley Bennett
*Attorney, Agent, or Firm*—McCormick, Paulding & Huber

[57] ABSTRACT

A liquid dispensing system and a packaging apparatus which includes such a system has a chamber 6 of a chryogenic vessel 2 containing a reservoir of liquid gas 1 (such as nitrogen, oxygen or argon) which is to be dispensed in doses 26 through an outlet port 12 which is in constant communication with a sub-chamber 17. The sub-chamber 17 is part of a piston 16 and cylindr 15 device in which the piston is reciprocated by means 21 and 24 to expand and contract the sub-chamber. When the sub-chamber 17 is expanded, liquid gas enters from the reservoir 1 through flow ports 18 which are closed by the piston 16 during contraction of the sub-chamber to dispense a dose 26.

Mounted beneath the outlet port 12 is a tubular skirt having internal passages 30 through which purging gas directed into the region 29 adjacent to the outlet port 12. The region 29 is purged of air to alleviate ice build-up at the outlet port 12. The purging gas liquifies at a temperature not greater than the temperature of the liquid gas at the outlet port and provides a back-pressure at the outlet port to restrain flow of liquid gas therethrough prior to the contraction of the sub-chamber 17 to dispense a dose.

The doses 26 are dispensed into open topped containers that are moved successively beneath the outlet port 12 and means 50 is provided for sensing the containers and controlling the devices 21 and 24 to maintain synchronization between the dispensing and the movement of the containers.

15 Claims, 1 Drawing Sheet

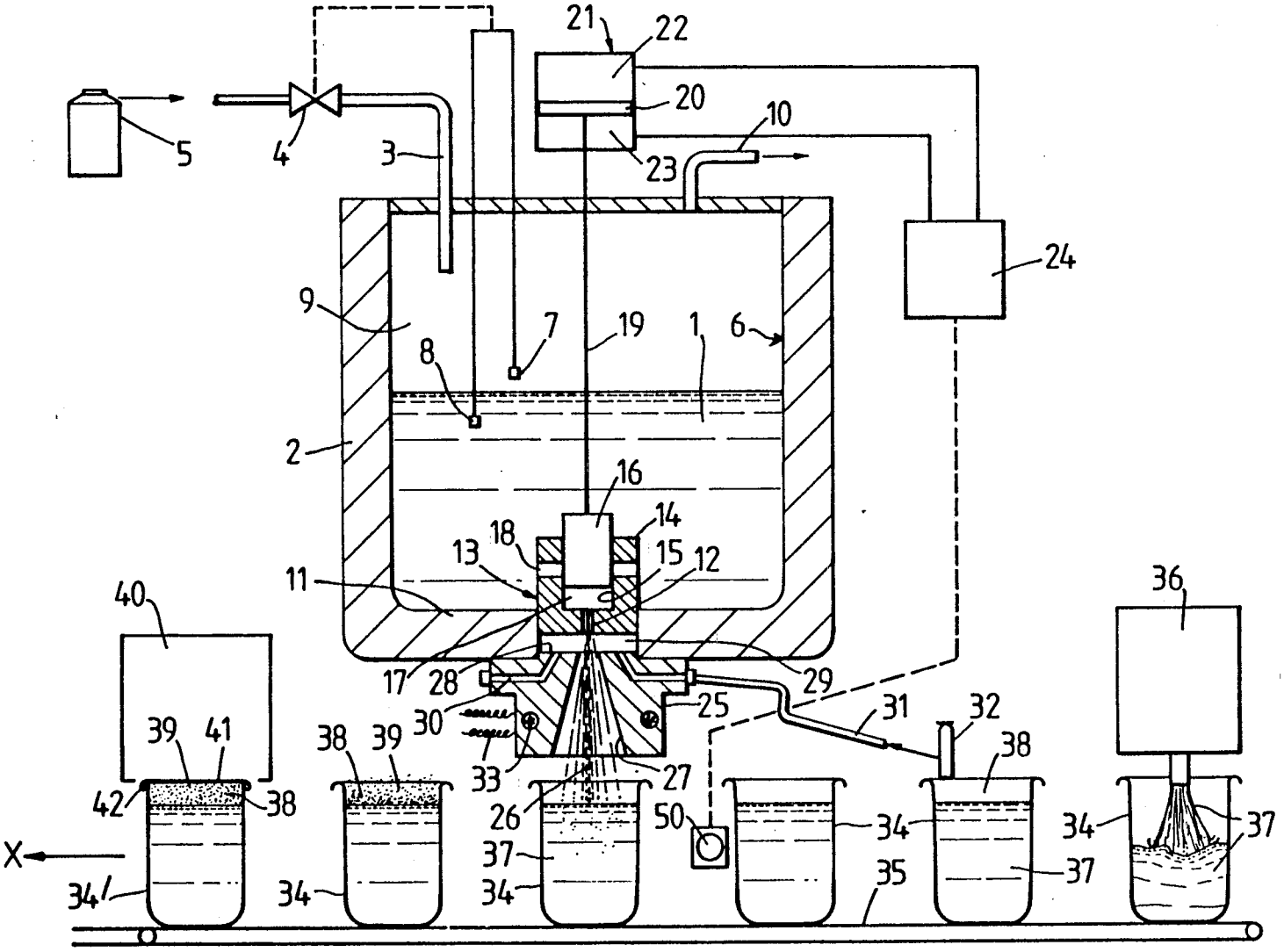
1
2
3
4
5
6
7
8
9
10
11
12
13
14
15
16
17
18
19
20
21
22
23
24
25
26
27
28
29
30
31
32
33
34
35
36
37
38
39
40
41
42
50
X

LIQUID DISPENSING SYSTEM AND PACKAGING APPARATUS WHICH INCLUDES SUCH A SYSTEM

TECHNICAL FIELD AND BACKGROUND ART

The present invention relates to a liquid dispensing system and packaging apparatus which includes such a system. It is particularly concerned with a system for dispensing liquid gas by which is meant a gas in liquid form and which liquid vapourises at a temperature less than zero degress centigrade at atmospheric pressure. Typical examples of liquid gases are nitrogen, oxygen and argon. These liquid gases, sometimes referred to as cryogenic liquids, are widely used in industry, inter alia for the pressurising and/or purging of foodstuff or beverage packages or containers.

A conventional system for dispensing liquid gas (as above defined) is known in the art as the Meser Griesheim system in which a reservoir of liquid gas is maintained, substantially at a constant depth, in an insulated vessel having an outlet port through which a constant stream of the liquid gas emerges under gravity; the liquid gas stream is directed downwardly into the open tops of packages which are fed successively beneath the outlet port. The dose of liquid gas which each package receives is primarily determined by the head of liquid gas in the reservoir, the dimensions of the outlet port and the speed at which the package passes on a conveyor beneath the outlet port; the intention is that these characteristics are adjusted to provide a predetermined volume of liquid gas in each package so that such liquid gas will vapourise to purge the package of air and/or provide a predetermined pressure within the package when the latter is sealed (which usually occurs immediately following the dosing of the package with the liquid gas).

A particular problem encountered with the aforementioned Griesheim system is that although the vessel for the liquid gas is insulated, there is a tendency for the outlet port to become blocked with ice build-up as water droplets in the atmosphere freeze around the outlet port. A similar problem can occur when liquid gas is dosed into packages which contain liquid and liquid droplets caused by back-splashing from the package can freeze on and around the outlet port. Clearly such freezing has a detrimental effect upon the dosages which are applied to the packages/containers. In an attempt to alleviate this ice build-up the container vessel of the liquid gas reservoir is provided with an electrical heater in the vicinty of the outlet port with the intention that the ice can be melted off as required. However, in practice and even with an electrical heater, it is found that the outlet port becomes blocked with ice and it is necessary to halt the package conveyor and dispensing system, empty it of liquid gas and clean off the outlet port and adjacent areas with the resultant expense and inconvenience.

A further disadvantage of the Griesheim system is that the continuous stream of liquid gas that is dispensed usually results in considerable quantities of it being wasted, especially where the open topped packages pass beneath the outlet port successively in a spaced array. Further, it is often found that there are inconsistencies in the dosages of liquid gas which are applied to the open topped containers, for example as a result of the outlet port becoming restricted or blocked as aforementioned or by the speed of the conveyor for the open topped packages changing inadvertently.

It has been proposed to modify the Griesheim system, for example as disclosed in British patent specification No. 2,215,446A, to include a reciprocating valve member in the reservoir which opens and closes the outlet port. The valve member is controlled to interrupt the stream of liquid gas which emerges from the outlet port so that doses of liquid gas are dispensed successively and these can be synchronised with open topped packages passing beneath the outlet port. Although this alleviates wastage of the liquid gas as compared with the constant stream dispensing system, the gravity feed of the liquid gas through the outlet port is susceptible to changes in the depth or head of the liquid gas in the reservoir and as a result of changes in this depth the doses of liquid gas which are dispensed frequently vary in volume to an unacceptable extent. Furthermore, the gravity feed of the liquid gas through the outlet port restricts the speed at which successive doses can be dispensed, thereby restricting the rate at which the doses can be introduced successively into the open topped packages (so that system is generally regarded as being appropriate for low speed packaging only).

It has also been proposed, for example in British patent specification A-392,655, to dispense liquid through an outlet port of a reservoir by use of a reciprocating piston and cylinder device in the reservoir. In this proposal the outlet port is provided with a spring loaded non-return valve which closes the outlet port as the piston moves to expand a chamber in its cylinder and draw liquid into that chamber from the reservoir and which opens under pressure from the liquid in the chamber as that chamber is contracted by movement of the piston to eject a dose of liquid through the outlet port. Although this proposal has the advantage that the reciprocating piston may provide successive liquid doses at high speed it is quite unsuitable for use in dispensing cryogenic liquids or liquid gas. In use with liquid gas the non-return valve in the outlet port would rapidly seize or become frozen at the low temperatures involved and thus require frequent servicing which would be unacceptable in a high speed packaging system.

It is an object of the present invention to provide a cryogenic liquid or liquid gas dispensing system and by which the problems of known liquid dispensing systems and as discussed above may be alleviated.

STATEMENT OF INVENTION AND ADVANTAGES

According to the present invention there is provided a cryogenic liquid or liquid gas dispensing system comprising a thermally insulated main chamber for cryogenic liquid gas; an expandible and contractible sub-chamber within the main chamber, the sub-chamber having an outlet port through which it is in constant communication with a purging region adjacent to the outlet port and through which liquid gas is to be dispensed; displacing means for successively and sequentially expanding and contracting the sub-chamber; feed port means providing communication between the main chamber and sub-chamber and which feed port means is opened during expansion of the sub-chamber to admit liquid gas thereto from the main chamber and is closed during contraction of the sub-chamber for a predetermined volume dose of liquid gas in the sub-chamber to be ejected under pressure from the outlet port for dispensing through the purging region; purging means associated with the purging region and a source of purging gas communicating with the purging means, said purging gas liquifying at a temperature not greater than the temperature of the liquid gas at the outlet port and being directed by the purging means into the purging region to purge that region of air, and wherein said purging gas provides a back-pressure at the outlet port which restrains flow of liquid gas from the sub-chamber through the outlet port until liquid gas in the sub-chamber is pressurised sufficiently by the contraction of the sub-chamber to overcome said back pressure and be ejected from the outlet port.

By the present invention it is envisaged that the space or region adjacent to the outlet port on the side of said port remote from the liquid gas chamber is purged of air by use of the purging gas which is directed, preferably continuously into the aforementioned space or region. By this purging technique, moisture in the air is prevented from condensing and freezing at the outlet port and thus blockages are alleviated. Furthermore, the purging gas is applied in the region of the outlet port at a pressure which is sufficient to restrain liquid gas from flowing through the outlet port until the liquid gas in the sub-chamber is pressurised sufficiently by contraction of that sub-chamber to overcome the back pressure of the purging gas. Consequently as the sub-chamber is charged with liquid gas from the main chamber, the back pressure of the purging gas prevents liquid gas from flowing through the constantly open outlet port. The back pressure can also prevent liquid gas from leaking from the outlet port if dispensing is stopped while the sub-chamber contains liquid gas. Also the pressure of the purging gas may alleviate liquid droplets caused by back-splashing as previously mentioned from contacting and freezing on the outlet port. The purging gas should, of course, be compatible with the liquid gas, for example to ensure that the characteristics of the liquid gas as dispensed are not adversely affected, possibly by the purging gas being drawn into the sub-chamber through the outlet port during expansion of that chamber. Compatibility is also intended in the sense that the purging gas liquifies at a temperature not greater than the temperature of the liquid gas at the outlet port to ensure that the purging gas itself will not condense and possibly freeze on the outlet port and thereby cause blockages. Preferably the purging gas is the same as the liquid gas in gaseous form so that, for example, if liquid nitrogen is to be dispensed by the system, nitrogen gas is used as the purging gas. Where the liquid gas and purging gas are the same, the source of purging gas is conveniently provided by evaporation from the liquid gas.

The outlet port preferably directs the liquid gas downwardly and communicates with a shroud, such as a tubular skirt, through which the liquid gas passes after being dispensed through the outlet port. The shroud is provided with one or more gas ports through which the purging gas is directed into the region of the outlet port so that such region is purged of air. If required, the shroud can be provided with an electrical heater to alleviate the build up of ice thereon (which may develop by the condensation and freezing of water vapour in air that may come into contact with the shroud remote from the purged region) also, or alternatively the purging gas can be heated prior to entering the purging region.

The sub-chamber is preferably a piston chamber of a piston and cylinder device which piston chamber expands and contracts during relative reciprocation between the piston and its cylinder. The expansion and contraction of the sub-chamber, particularly when in the form of the piston and cylinder device, may be achieved rapidly by the displacing means so that intermittent doses of the liquid gas can be ejected for dispensing at high speed. Conveniently the aforementioned piston cylinder comprises a nozzle within which is located the outlet port. This outlet port which may be adjustable in size is secured relative to the cryogenically insulated vessel (that forms the main chamber or reservoir of liquid gas) while the piston is connected to drive means for reciprocating it in its cylinder. Preferably the displacing means is adjustable for adjusting the predetermined volume of liquid gas which is dispensed, for example by adjusting the relative expansion and contraction which is provided by the sub-chamber. Where the sub-chamber is part of a piston and cylinder device the adjustment in volume of liquid gas that is dispensed may be achieved by varying the effective stroke of the piston. Also the piston and cylinder device may be interchangeable with different sized devices as appropriate to suit the required volume and/or pressure at which the liquid gas is dispensed. The intermittent displacement and dispensing of the liquid gas doses will be phased or timed as appropriate, particularly in a packaging apparatus where a single metered dose of liquid gas is to be directed downwardly from the outlet port into each of an array of open topped packages or containers which are moved on a conveyor beneath the outlet port. The expansion and contraction of the sub-chamber to eject metered doses of the liquid gas can be achieved in a wide variety of ways, for example mechanically by use of a rotating cam, electrically by use of solenoids or similar devices, or pneumatically/hydraulically by use of double acting piston and cylinder devices, all of which in a typical system would be synchronised to time the ejection of a metered dose of the liquid gas into the open top of the package or container as that open top passes beneath the outlet port.

Having in mind the preference of the present invention for dispensing predetermined volumes of the liquid gas intermittently through the outlet port, it will be appreciated that the system has considerable advantages in alleviating wastage of liquid gas and ensuring that appropriate doses of liquid gas can be applied to packages or containers in a packaging line, for example in the packaging of beverages, foodstuffs or other material in cans, cartons, bottles or other containers where the dose of liquid gas applied to each container prior to sealing thereof may be intended to purge the container of air prior to sealing and/or to pressurise the container to a required extent following sealing. With this in mind, there is further provided packaging apparatus which comprises a liquid gas dispensing system as specified as being in accordance with the present invention and in which an array of open topped packages or containers are conveyed successively beneath the outlet port to a sealing station and successive doses of liquid gas are dispensed downwardly from the outlet port one into each package or container through the open top thereof, and means is provided for maintaining the dispensing of said doses synchronised with the movement of the open topped packages or containers beneath the outlet port.

DRAWINGS

One embodiment of a liquid gas dispensing system constructed in accordance with the present invention and incorporated in beverage or foodstuff packaging apparatus will now be described, by way of example only, with reference to the accompanying illustrative drawing in which the system and the packaging apparatus are shown diagrammatically.

DETAILED DESCRIPTION OF DRAWING

The liquid gas dispensing system in the illustrated embodiment will be considered in relation to the dispensing of liquid nitrogen although it will be appreciated that other liquid gases as defined, such as liquid oxygen or argon, can be used. A reservoir of liquid nitrogen 1 is provided in a chamber 6 of a cryogenically insulated vessel 2 through an inlet pipe 3 and by way of a control valve 4 from a liquid nitrogen storage tank 5. The volume or level of the liquid nitrogen reservoir 1 is maintained in the main chamber 6 of the vessel 2 within predetermined limits by use of high level and low level electrical sensors 7 and 8 respectively—these respond to the liquid nitrogen level and control the valve 4 so that when the level falls to the sensor 8 the valve is opened to admit liquid nitrogen through the pipe 3 and when the level rises to contact the sensor 7 the valve 4 closes. The headspace 9 of the vessel 2 is provided with a vent 10 through which nitrogen gas vaporising from the liquid nitrogen can vent to atmosphere.

Located in a bottom wall 11 of the vessel 2 is a downwardly directed outlet port 12 formed as a constantly open cylindrical bore in a nozzle 13 which is sealed to the wall 11 (but is preferably removable therefrom to be interchangeable with other, differently sized, nozzles and/or outlet ports). If required the outlet port 12 can be adjustable in size on the nozzle. The nozzle 13 has an annular wall 14 which is upstanding in the chamber 6 and forms a cylinder 15 within which is received a cylindrical piston 16 for axial displacement in close sliding relationship therewith. A sub-chamber 17 in constant communication with the outlet port 12 is formed between the piston cylinder 15 and an end face of the piston 16. Extending through the annular wall 14 are a circumferentially spaced array of feed ports 18 which communicate between the piston cylinder 15 and the vessel chamber 6 and are submerged in the liquid nitrogen reservoir 1.

Extending upwardly from the piston 16 is a rod 19 that connects with a piston 20 of a pneumatically operated double acting piston and cylinder device 21 having opposed piston chambers 22 and 23. The piston 20 can exhibit reciprocation by the alternate admission of air under pressure to and exhausting of the chambers 22 and 23 in conventional manner under control of a unit 24. During reciprocation of the piston 20, the piston 16 reciprocates in unison therewith through the rod 19. The piston 16 will have an inner and outer stroke (downwardly and upwardly respectively in the drawing) during which the sub-chamber 17 is contracted and expanded respectively. At the end of its outer stroke the piston 16 opens the feed ports 18 to communication with the sub-chamber 17 and liquid nitrogen in the main chamber 6 flows from that chamber through the feed port 18 into the sub-chamber 17. During its subsequent inward stroke the piston 16 closes the ports 18 and pressurises the liquid nitrogen in the contracting sub-chamber 17 to dispense all or part of that liquid nitrogen in the sub-chamber through the outlet port 12. On the next outward stroke of the piston 16, the feed ports 18 are again open to communication with the sub-chamber 17 for the admission of liquid nitrogen into the sub-chamber and subsequent dispensing of that liquid nitrogen. With a constant stroke for the piston 16 it will be apparent that a metered and predetermined volume of liquid nitrogen (or substantially such a predetermined volume bearing in mind the possibility that small bubbles of gaseous nitrogen may be present in the liquid bulk) can be dispensed through the outlet port 12. Preferably the stroke of the piston 16 is adjustable (by appropriate adjustment of the double acting device 21 or its control unit 24) to adjust the position at which the inward stroke of the piston 16 bottoms and thereby adjust the volume of liquid nitrogen which is dispensed from the sub-chamber 17.

Carried by and mounted beneath the bottom wall 11 of the vessel 2 is a shroud or skirt 25 having a tubular passage 27 through which a liquid nitrogen dose 26 dispensed from the sub-chamber 17 passes. The tubular passage 27 is frusto conical to converge as it approaches the outlet port 12 where it substantially coincides with that outlet port. The passage 27 emerges in an annular end face 28 of the shroud 25 adjacent to the outlet port 12. The face 28 is spaced from, but adjacent to, the nozzle 13 to form a purging region or space 29. Extending through the shroud 25 are passages 30 which open at one end at a circumferentially spaced array of ports in the end face 28 of the shroud and at their other end communicate with a pipe 31 through which nitrogen gas under pressure is admitted from a nitrogen gas tank or other source 32. Nitrogen gas is passed by way of the pipe 31 and passages 30 to be directed into the region 29 to purge that region of air. Such purging alleviates the build-up of ice on the nozzle 13 which may otherwise result if the nozzle is maintained in contact with air and moisture in the air condenses and freezes on the nozzle to possibly block or restrict the outlet port 12. It will also be appreciated that as the sub-chamber 17 expands during the outward stroke of the piston 16, nitrogen gas from the purged region 29 may be drawn into the sub-chamber but this will not have any adverse effects due to the compatability between the liquid nitrogen and the purging nitrogen gas. The purging nitrogen gas can be at a relatively low pressure. However the pressure of the nitrogen gas in the purging region 29 is sufficient to provide a back pressure that alleviates leakage or flow of liquid nitrogen from the sub-chamber 17 through the outlet port 12 until such time as the liquid nitrogen in the sub-chamber is pressurised sufficiently by the inward (downward) stroke of the piston 16 to effect dispensing. Furthermore because of the back-pressure provided by the purging gas which restrains flow of the liquid nitrogen from the sub-chamber 17 until the liquid nitrogen in that sub-chamber is subjected to adequate pressure from the inward state of the piston 16 to effect dispensing, the static height of the liquid nitrogen in the main chamber 6 is not critical to achieving a constant and predetermined volume of the dose of liquid nitrogen which is dispensed.

Although the source 32 of nitrogen gas for purging will usually be derived from a container separate from the liquid nitrogen, it will be realised that the purging gas can be derived from evaporation of the liquid nitrogen at the source 5 or from gas which emanates from the vent 10.

It is possible that the part of the shroud 25 which is remote from the purging region 29 will become iced during prolonged use, for example if water vapour in the air condenses and freezes, on the exterior of the shroud. To alleviate this the shroud 25 can include an electrical heater 33 or alternatively the nitrogen gas for purging can be heated prior to entering the purging region 29, typically to approximately 60° C.

The embodiment of the liquid nitrogen dispensing system illustrated forms part of a packaging apparatus which, conveniently, is for the packaging of beverage such as stout in cylindrical cans or other containers. The packaging apparatus includes a conventional canning line in which open topped cans 34 in an upstanding condition are fed continuously on a conveyor 35 sequentially and in a spaced array in the direction of arrow X. The cans 34 pass beneath a beverage filling station 36 which charges each can with a metered volume of beverage 37. The volume of beverage 37 with which the can is charged provides a headspace 38 in the can. The charged cans pass beneath the outlet port 12 in the beverage dispensing system at high speed and a metered dose 26 of liquid nitrogen is applied to the headspace 38 through the open top of each can. Upon being deposited in the headspace, the liquid nitrogen commences to vapourise as indicated at 39 to purge the headspace of air and immediately thereafter the can (shown at 34') passes into a topping and seaming unit 40 where a cap or cover 41 is applied to the open top of the container and seamed thereto at 42 to seal the contents of the beverage package which is thus formed. Following sealing of the can, the liquid nitrogen dose in the headspace 38 continues to evaporate and pressurises the headspace to an extent considered appropriate, for example in the packaging of beverages containing gas in solution as disclosed in our British Patent Publication No. 2,183,592.

During dosing of the beverage 37 with liquid nitrogen 26 it is possible that droplets of the beverage will splash-back towards the shroud 25. However, the pressure of the purging gas in the region 29 can serve to alleviate such beverage droplets from reaching the outlet port 12 and nozzle 13 and possibly freezing thereon.

As previously explained, the liquid nitrogen dose 26 is dispensed by reciprocation of the piston 16 under control of the unit 24. To ensure that this dispensing is synchronised with the location of an open topped can 34 to receive a dose from the outlet port 12, a sensor 50 is provided adjacent to the canning line to detect the position of a can 34 and provide a signal to the control unit 24 which triggers a dispensing operation when the open top of the can is appropriately positioned to receive the dose as it passes continuously beneath the outlet port 12.

It will be realised that the liquid gas dispensing system as above described and illustrated can be used for applying liquid gas doses for a wide range of purposes for example:

(a) dosing bottles or other non-metallic containers;

(b) dosing containers prior to filling to help exclude oxygen and alleviate oxygen content in the headspace subsequent to filling;

(c) dosing flexible containers, such as plastics packages, for stability purposes, and (d) dosing containers of oxygen sensitive foodstuffs to maintain or enhance flavour or to improve the shelf life and stability of the food product.

I claim:

1. A cryogenic liquid or liquid gas dispensing system comprising a thermally insulated main chamber for cryogenic liquid gas; an expandible and contractible sub-chamber within the main chamber, the sub-chamber having an outlet port through which it is in constant communication with a purging region adjacent to the outlet port and through which liquid gas is to be dispensed; displacing means for successively and sequentially expanding and contracting the sub-chamber; feed port means providing communication between the main chamber and sub-chamber and which feed port means is opened during expansion of the sub-chamber to admit liquid gas thereto from the main chamber and is closed during contraction of the sub-chamber for a predetermined volume dose of liquid gas in the sub-chamber to be ejected under pressure from the outlet port for dispensing through the purging region; purging means associated with the purging region and a source of purging gas communicating with the purging means, said purging gas liquifying at a temperature not greater than the temperature of the liquid gas at the outlet port and being directed by the purging means into the purging region to purge that region of air, and wherein said purging gas provides a back-pressure at the outlet port which restrains flow of liquid gas from the sub-chamber through the outlet port until liquid gas in the sub-chamber is pressurised sufficiently by the contraction of the sub-chamber to overcome said back-pressure and be ejected from the outlet port.

2. A system as claimed in claim 1 in which liquid gas is dispensed downwardly through the outlet port.

3. A system as claimed in claim 1 in which the purging means comprises a shroud through which the dispensed liquid gas passes and said shroud carries at least one gas passage through which the purging gas is passed to said region.

4. A system as claimed in claim 3 in which the shroud is tubular and comprises at least one internal passage and gas port through which the purging gas is directed into said region.

5. A system as claimed in claim 3 in which the shroud is provided with an electrical heater.

6. A system as claimed in claim 1 in which the sub-chamber is a piston chamber of a piston and cylinder device, which piston chamber expands and contracts during relative reciprocation between the piston and its cylinder.

7. A system as claimed in claim 6 in which the piston cylinder is secured relative to the thermally insulated chamber and the piston is connected to drive means for reciprocating it in its cylinder.

8. A system as claimed in claim 1 in which the displacing means is adjustable for adjusting the dose of liquid gas which is dispensed through the outlet port.

9. A system as claimed in claim 6 in which the reciprocation between the piston and its cylinder is adjustable in its stroke to adjust the relative expansion and contraction of the sub-chamber and thereby adjust the dose of liquid gas that is dispensed.

10. A system as claimed in claim 1 in which the purging gas comprises the liquid gas in gaseous form.

11. A system as claimed in claim 10 in which the purging gas is derived from the liquid gas.

12. A system as claimed in claim 1 and comprising means controlling, within predetermined limits, the depth and thereby volume of liquid gas in the main chamber.

13. A system as claimed in claim 12 in which the depth control means comprises high level and low level electrical sensors that are responsive to the level of liquid gas in the main chamber and which control actuation of a valve through which liquid gas is admitted to said main chamber.

14. A system as claimed in claim 1 and comprising heating means by which the purging gas is heated prior to entering the purging region.

15. A packaging apparatus which comprises a liquid gas dispensing system as claimed in any one of the preceding claims in which the displacing means intermittently dispenses doses of liquid gas through the outlet port and in which an array of open topped packages or containers are moved successively beneath the outlet port to a sealing station and the intermittent doses of liquid gas are dispensed downwardly from the outlet port one into each package or container through the open top thereof, and means is provided for maintaining the dispensing of said doses synchronised with the movement of the open topped packages or containers beneath the outlet port.

* * * * *